US005176446A

United States Patent [19]

Chiba et al.

[11] Patent Number: 5,176,446

[45] Date of Patent: Jan. 5, 1993

[54] MAGNETIC TYPE AGITATOR WHICH IS CAPABLE OF GENERATING ULTRASONIC WAVE

[76] Inventors: Shigeru Chiba; Kazuo Ito, both of 28-1-1 Sannoucho 4-chome, Minami-ku, Yokohama-shi, Japan

[21] Appl. No.: 747,205

[22] Filed: Aug. 19, 1991

[51] Int. Cl.[5] ..... B01F 11/02; B01F 13/08

[52] U.S. Cl. ..... 366/114; 366/274

[58] Field of Search ..... 366/273, 274, 127, 128, 366/108, 110, 111, 113, 114, 115, 116, 117, 118; 68/3 SS

[56] References Cited

U.S. PATENT DOCUMENTS 2,655,011 10/1953 Ihle ..... 366/274
4,199,265 4/1980 Sanderson ..... 366/274
4,979,829 12/1990 Allen ..... 366/118
4,991,973 2/1991 Maaz ..... 366/274

*Primary Examiner*—Robert W. Jenkins
*Attorney, Agent, or Firm*—Cushman, Darby & Cushman

[57] ABSTRACT

A magnetic type agitator, is provided which has a magnetic agitator element disposed in a magnetically permeable vessel, and a magnetic rotating plate rotatably coupled to the bottom of the vessel. The magnetic type agitator is improved according to present invention in that it further includes a thin ultrasonic vibrating element fixed to the bottom of the vessel, the magnetic rotating plate being placed so as to permit the magnetic force from the magnetic rotating plate to effect the magnetic agitator element, thereby permitting simultaneous agitation and ultrasonic vibration of the liquid in the vessel.

10 Claims, 6 Drawing Sheets

MAGNETIC TYPE AGITATOR WHICH IS CAPABLE OF GENERATING ULTRASONIC WAVE

BACKGROUND OF THE INVENTION

1. Field of the Invention

The present invention relates to a magnetic type agitator for mixing different liquids or liquid with pulverized material, and more particularly to such an agitator which permits transmission of ultrasonic wave into liquid while being agitated.

2. Description of the Prior Art

As is well known, mixing and agitating of different liquids or liquid with pulverized material is performed widely in chemical, medicine, food, agricultural or agricultural technology industries. For example, it is desired that liquid is homogenized, or a desired ph-control is attained.

Radiation of ultrasonic wave into a solution causes cavitation therein, which is useful in performing different treatments on the solution. For example, ultrasonic wave is radiated into a solution having pulverized material suspended therein, causing cavitation in the solution to reduce particle size and provide a homogenized solution. For another example, ultrasonic wave is radiated into a solution to cause cavitation therein, and the heat caused by cavitation is used to expedite oxidation or deoxidization of the solution, thus modifying some ingredients of the solution, or ionizing selected components of the solution to control the degree of ionization of the whole solution. The mechanisms in these processes are not known, but ultrasonic energy has been used widely in different industrial fields.

Usually in mixing different liquids or liquid with pulverized material, a magnetic type agitator is used. A magnetic agitating element is put in a magnetically permeable vessel which contains different liquids, or liquid and pulverized material, and a rotating magnetic plate is made to rotate below the bottom of the vessel, thereby causing the magnetic agitating element to rotate in the vessel and agitate the bath.

Magneto- or electro-striction is used to radiate ultrasonic wave into a solution, thereby causing cavitation therein. A vessel has magneto- or electro-striction elements attached to its bottom or side walls.

In case where one and same object is subjected to agitation by a magnetic type agitator, and ultrasonic treatment by an ultrasonic wave generator, it is subjected to agitation and ultrasonic treatment at different places and times. In an attempt to subject an object simultaneously to these different treatments, an electro-striction element is placed adjacent to the rotating magnetic plate of the magnetic type agitator. In this arrangement, however, the electro-striction element may constitute an obstacle against rotation of the rotating magnetic plate. Electro-striction elements when attached to the side wall surface of the cylindrical vessel will constitute no obstacle, but it is difficult to attach the relatively flat surface of the electro-striction element to the curved surface of the cylindrical vessel.

As described earlier, it is difficult to combine magnetic type agitator and ultrasonic wave generator, and therefore, they are used separately in treating one and same object. In this connection there are some inconveniences and disadvantages as for instance, follows:

Agitation by a magnetic type agitator is followed by cavitation caused by an ultrasonic wave generator. Thus, the advantageous effect caused by agitation cannot be simultaneously combined with the advantageous effect caused by cavitation. In case where an electro-striction element is attached to the side of the vessel of a magnetic type agitator, the physical irregularity or unfitness between the flat electro-striction element and the curved surface of the vessel will cause uneven transmission of ultrasonic wave in the bath, and still disadvantageously whether ultrasonic wave can travel in the bath or not, depends on the level of solution. Thus, in fact, this composite structure is impractical.

SUMMARY OF THE INVENTION

One object of the present invention is to provide a magnetic agitation-and-ultrasonic vibration apparatus which permits simultaneous agitation and vibration of a solution, thereby improving the blending or homogenized degree or solution degree in the processes of pulverizing some selected substances in the solution, heating or enabling them to emit light.

Another object of the present invention is to provide such a composite structure which requires no substantial modification of a conventional magnetic type agitator in integrally combining the agitator with an ultrasonic wave generator.

To attain these objects a magnetic type agitator which has a magnetic agitating element rotatably fixed inside a magnetically permeable vessel, and a magnetic rotating plate rotatably fixed to the bottom of said vessel, thereby agitation of liquid inside of said vessel by rotating said magnetic rotating plate, is improved accordingto the present invention in that: it further comprises a thin ultrasonic vibrating element fixed to the bottom of said vessel, said magnetic rotating plate being placed so as to permit the magnetic force from said magnetic rotating plate to have an effect on said magnetic agitating element, thereby permitting simultaneous agitation and ultrasonic vibration of said liquid in said vessel.

With this arrangement a solution can be agitated, and at the same time, it can be subjected to ultrasonic vibration, thereby breaking or heating some selected substances in the solution by cavitation caused in the solution.

Thus, the blending and solution degrees may be substantially improved. Placing the ultrasonic wave vibrator on the bottom of vessel, steadily fixes it to the vessel, and the ultrasonic wave can travel through the solution inrespective of the amount or level of solution in vessel. A very thin ultrasonic vibrating element is used, and therefore, there is no fear of impeding the magnetic influence from said magnetic rotating plate on said magnetic agitating element.

The present invention provides following advantages.

According to one aspect of the present invention a magnetic type agitator has a very thin ultrasonic vibrating element fixed to the bottom of the vessel of the agitator. The ultrasonic vibration causes cavitation in a solution, thereby breaking some selected substances in the solution or heating the solution while blending well. Placing of the ultrasonic vibrating element on the bottom of the vessel permits transmission of ultrasonic wave in the solution regardless of the quantity of the solution in the vessel. Also, advantageously, the flat ultrasonic vibrating element can be steadily fixed to the bottom of the vessel.

According to the second aspect of the present invention said vessel has a container inside. The container contains liquid, and the magnetic agitating element is put in the container. The annular space between the vessel and the container is filled with medium, which permits transmission of ultrasonic wave. This arrangement facilitates the changing of liquid to be treated.

According to the third aspect of the present invention a magnetic type agitator uses an electro-striction element as an ultrasonic vibrating element. A very thin electro-striction element can provide a sufficient amount of ultrasonic energy.

According to the fourth aspect of the present invention a magnetic type agitator comprises a plurality of vessels each having a very thin ultrasonic vibrating element fixed to its bottom. Accordingly, the working efficiency is increased.

According to the fifth aspect of the present invention a magnetic type agitator comprises a body, to which the vessel is integrally formed. This arrangement has the effect of preventing the vessel from falling from the body while being transported. Advantageously, the body has a space large enough to accomodate extra devices, such as devices for keeping the solution at a given constant temperature.

According to the sixth aspect of the present invention a magnetic type agitator comprises a plurality of containers in a single vessel. This arrangement increases the degree of freedom in selecting the size and shape of the container because of increased vessel size.

Other objects and advantages of the present invention will be better understood from the following description of preferred embodiments of the present invention, which are shown in accompanying drawings:

FIGS. 1 to 3 show a magnetic type agitator according to a first embodiment of the present invention.

Specifically, FIG. 1 is a perspective view of the magnetic type agitator;

FIG. 6 shows a magnetic type agitator which has a container fixed in the vessel whereas FIG. 7 shows a magnetic type agitator which has a plurality of containers fixed in the vessel.

Figure 1:
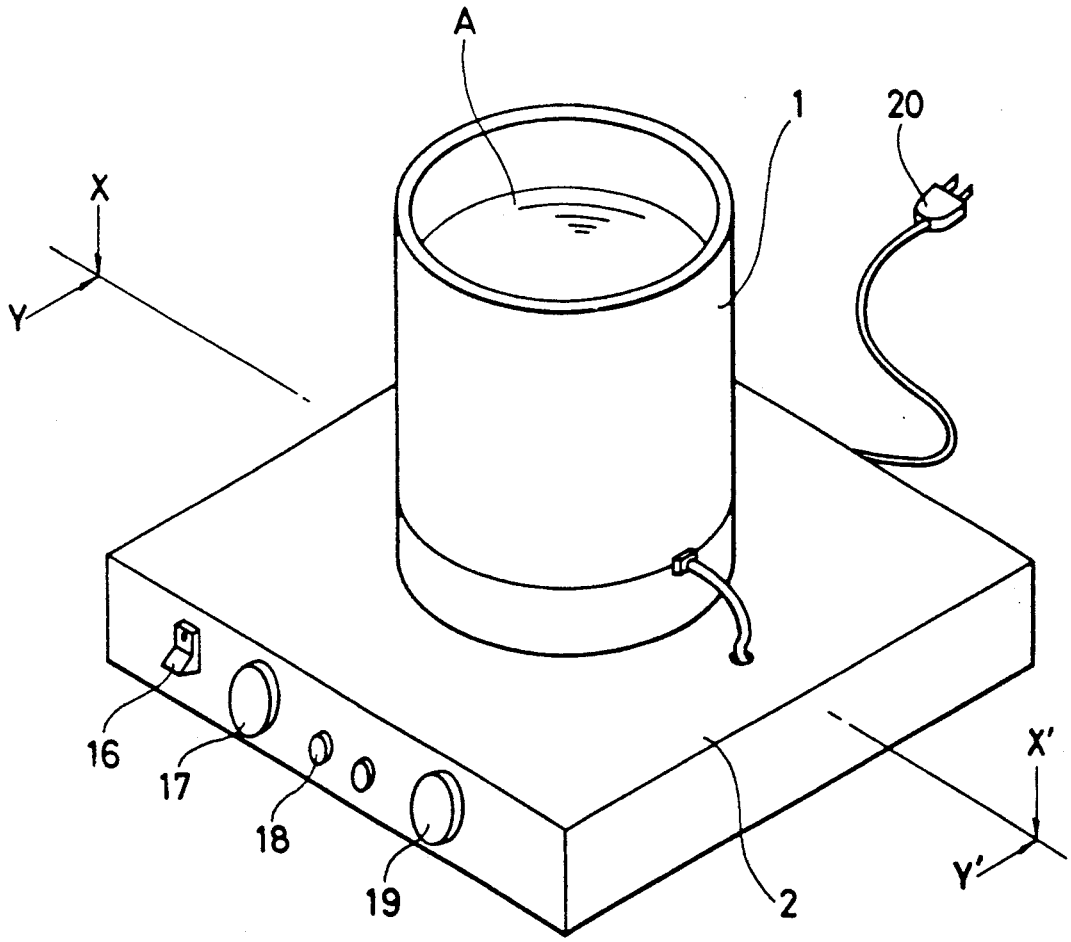
Figure 2:
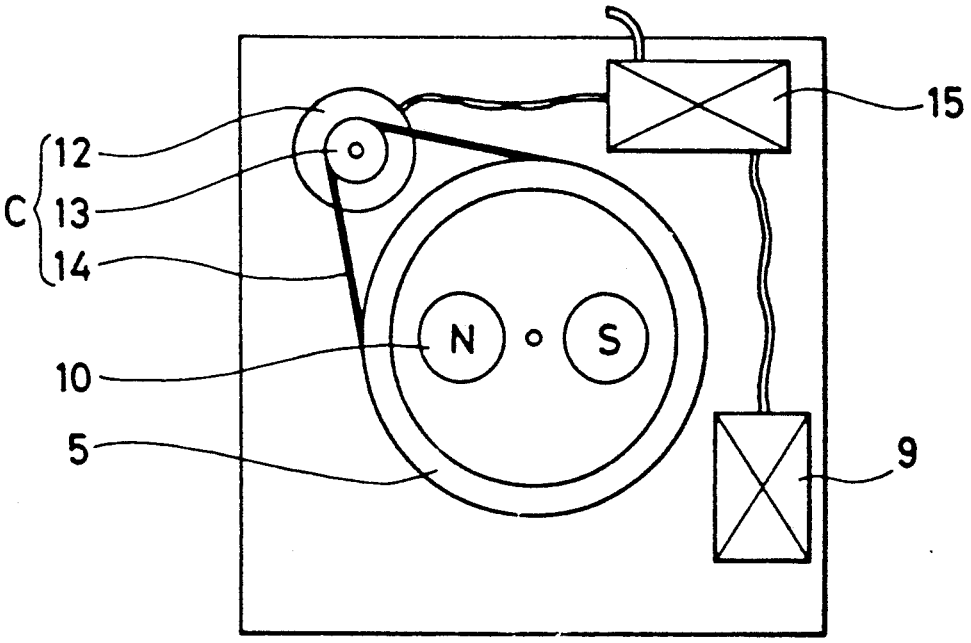
FIG. 2 is a view of the magnetic type agitator as seen in the direction indicated by line X—X' in FIG. 1.
Figure 3:
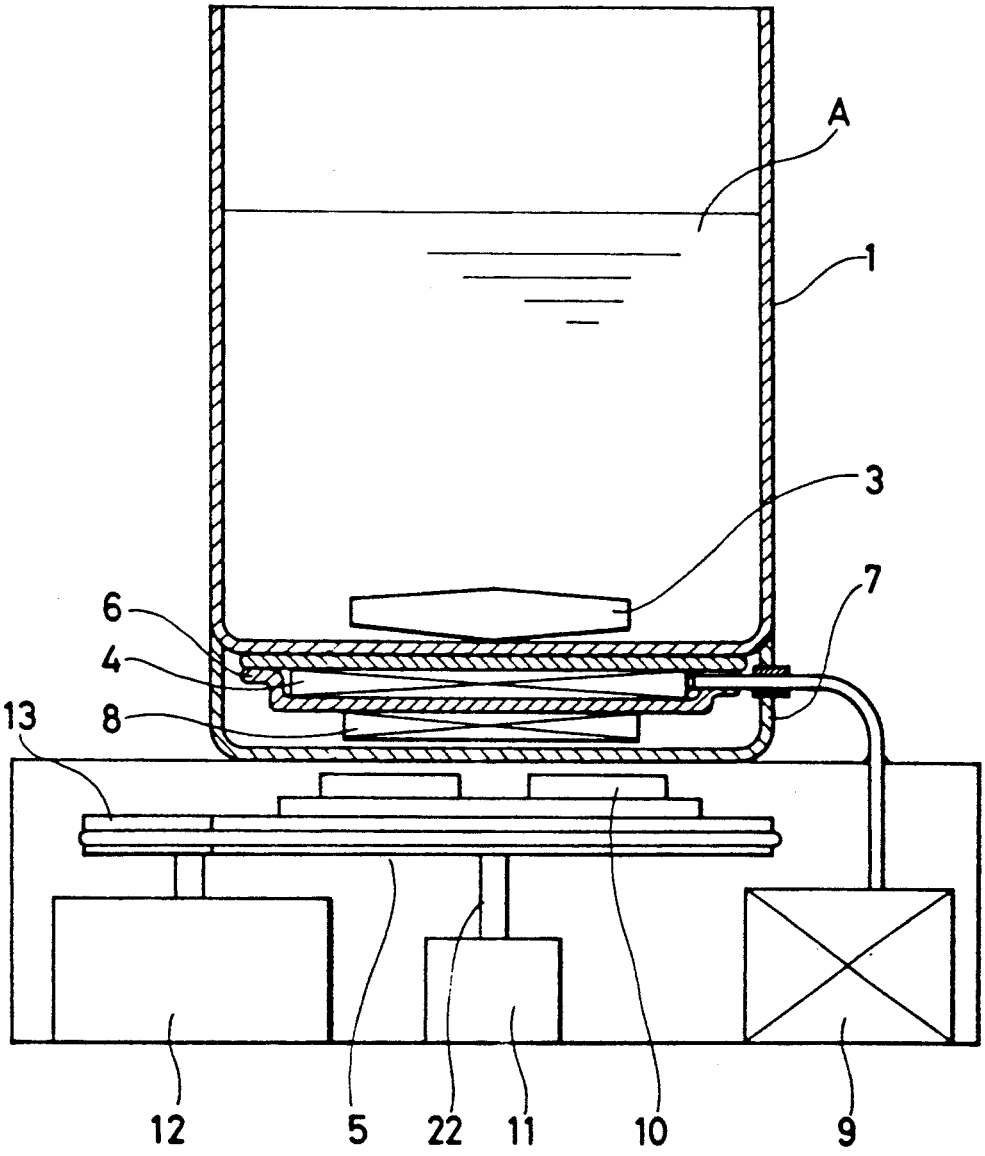
FIG. 3 is a view of the magnetic type agitator as seen in the direction indicated by line Y—Y' in FIG. 1, partly in section.

As shown in FIGS. 1 to 3, a magnetic type agitator comprises vessel 1 and body 2, both of which are made of a magnetically permeable material. Vessel 1 has ultrasonic vibrator element 4 or electrostriction vibrator fixed to its bottom. Vibrator element 4 has an enclosing insulation cover 6, thereby isolating it from the surrounding. Also, vibrator element 4 has cover 7 to prevent it from being exposed to solution or liquid. Body 2 has an ultrasonic wave generator 9, magnet rotating plate 5, transformer 15, drive transmission C and other mechanical parts contained therein. Magnet rotating plate 5 has magnet pieces 10 fixed thereto with their N and S poles facing upwards. The axle 22 of magnet rotating plate 5 is supported by bearing 11, and magnet rotating plate 5 can be rotated by drive transmission C, which is composed of motor 12, pulley 13 and belt 14. Also, body 2 has main switch 16, timer 17, selection switch 18, speed controlling switch 19 and the like fixed thereto, thereby permitting a desired operation of the agitator.

Figure 4:
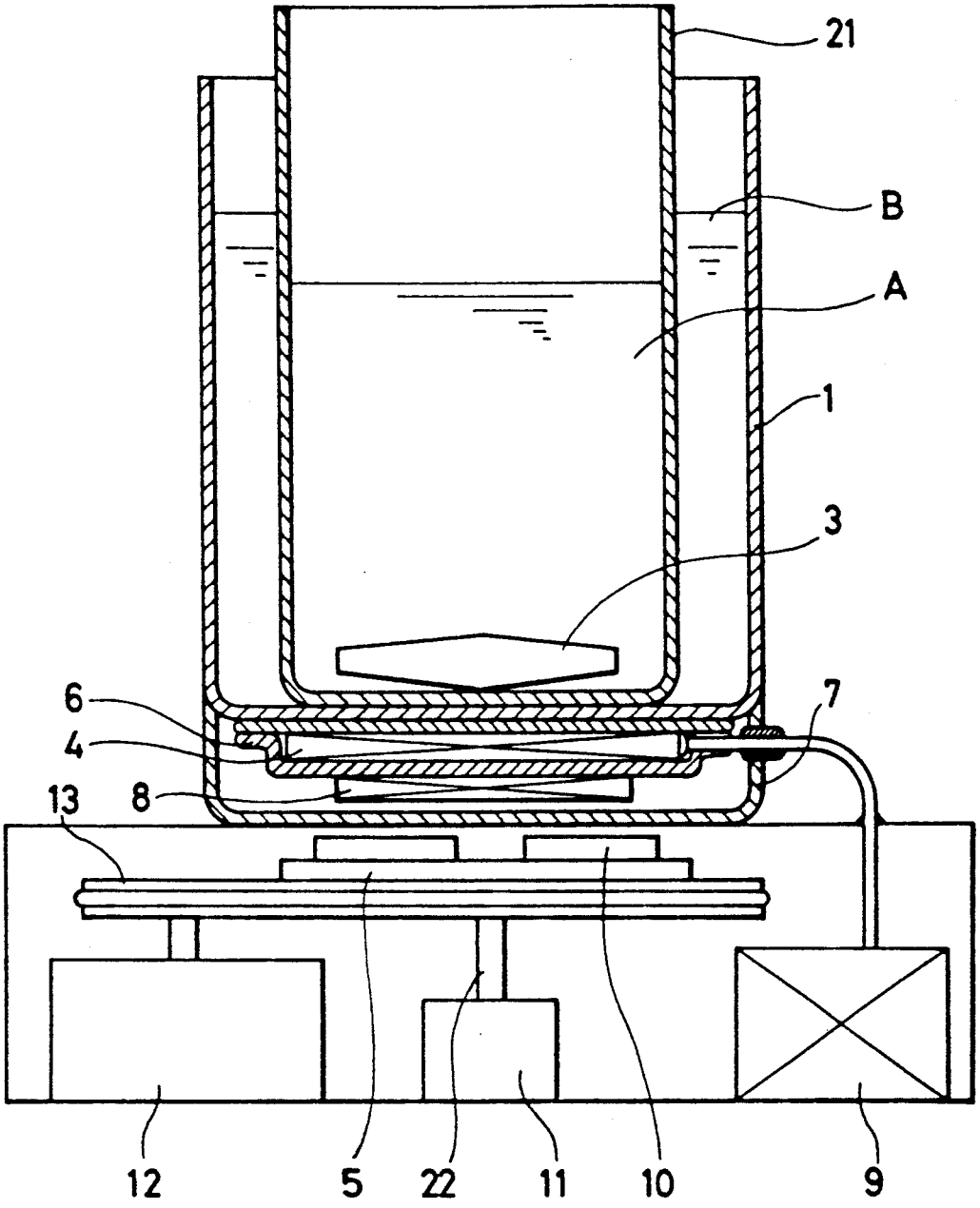
FIG. 4 shows the structure of a magnetic agitator according to a second embodiment of the present invention.

In operation, cylindrical, Teflon-coated magnet agitating element 3 is put in vessel 1, and liquid to be treated is put in vessel 1. Then, vessel 1 is put on body 2 just above magnet rotating plate 5. Ultrasonic vibrator element 4 is electrically connected to ultrasonic wave generator 9. Magnet agitating element 3 is made to rotate with rotation of magnet rotating plate 5, thereby agitating liquid A. At the same time, the ultrasonic wave is generated by ultrasonic wave generator 9, and is transmitted into liquid A via ultrasonic vibrator element 4, thus causing cavitation liquid A. As a result substance contained in the liquid is pulverized, or heated while the liquid is being agitated, thus improving the degree of blending of the solution. Selection switch 18 permits selection of agitation plus ultrasonic effect, agitation alone or ultrasonic effect alone. Timer 17 permits time setting of particular treatment thus selected, and speed control switch 19 permits adjusting of agitation speed to attain the best result in treatment. As shown in FIG. 4, magnet agitating element 3 and liquid A are put in container 21 such as beaker or flask, and container 21 is put in vessel 1. Then, medium B which can permit transmission of ultrasonic wave, such as water is put in the space between vessel 1 and container 21. This arrangement provides the advantage of facilitating change of liquid to be treated, thereby improving the efficiency with which required treatment is effected.

Figure 5:
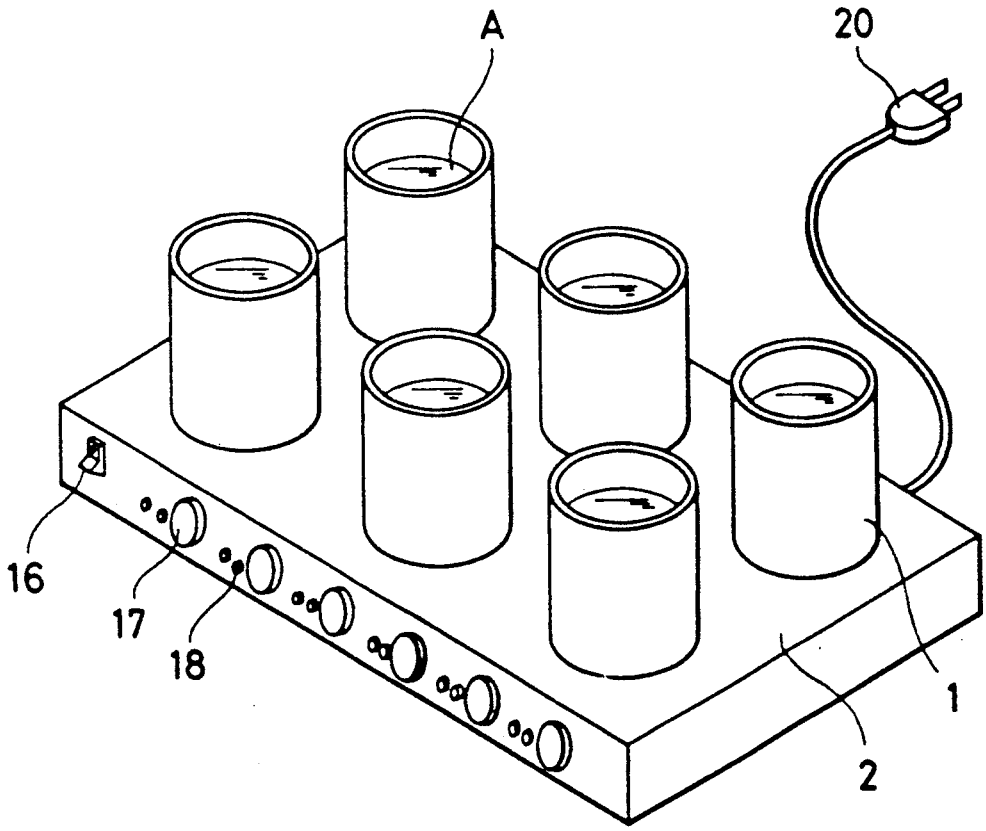
FIG. 5 is a perspective view of a magnetic type agitator according to a third embodiment of the present invention.

As seen from FIG. 5, a plurality of vessels 1 are put on a single body 2, each being put above each of magnet rotating plates as many as vessels 1. Thus, the plurality of treatments can be effected simultaneously. Selection switches 16, 17 and 18 permit a desired combination of selected treatments. This arrangement permits saving of the working space, which otherwise, would be large.

Figure 6:
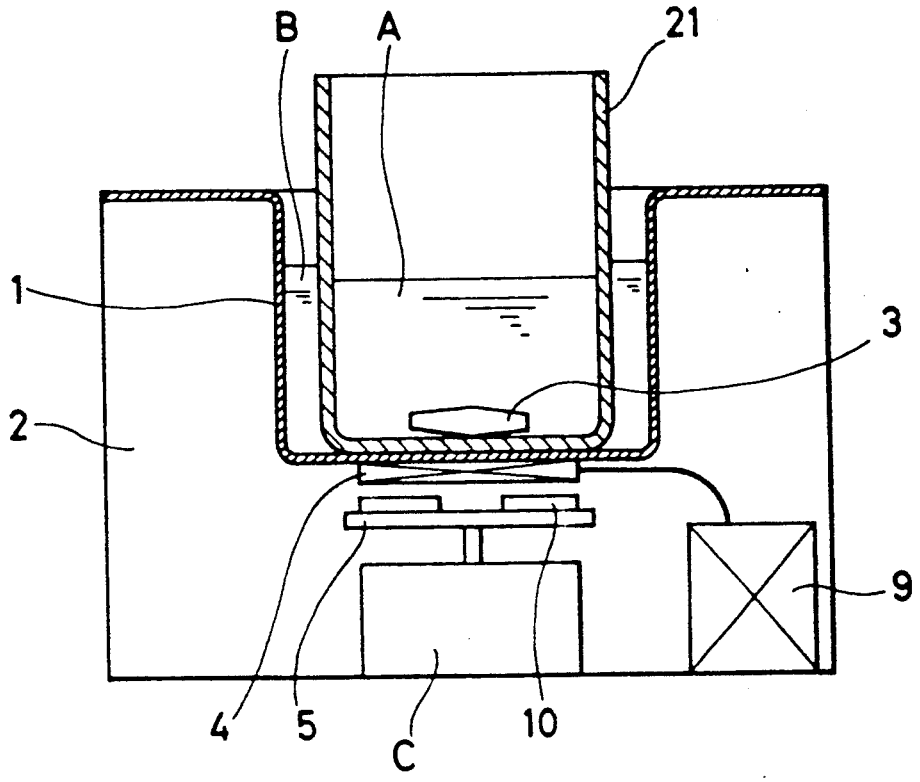
FIGS. 6 and 7 show a magnetic type agitator according to a fourth embodiment of the present invention which has a vessel integrated with its body. Specifically.
Figure 7:
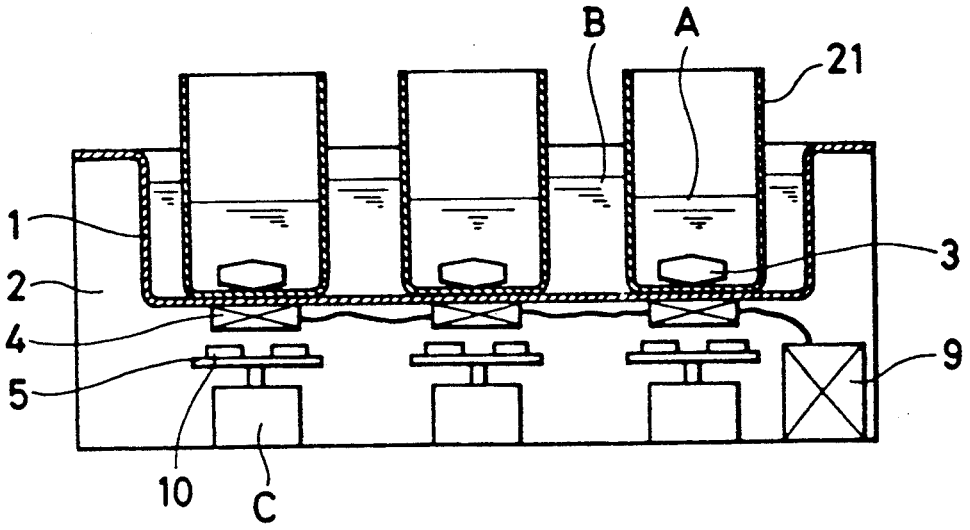

As seen from FIG. 6, vessel 1 is integrally connected to body 2, thereby permitting elimination of cover 7, and accordingly improving the magnetic permeability. The integration facilitates transportation of the agitator with its vessel 1 filled with liquid because of no fear of allowing vessel 1 to fall from body 2. As seen from FIG. 7, a plurality of containers 21 can be used. In this case the physical size of vessel 1 is large, compared with container 21, and accordingly, the degrees of size and shape freedoms of container 21 increase, permitting extensive selection of containers.

As shown in FIG. 3, heat sensor 8 may be placed in the vicinity of ultrasonic vibrator 4, thereby preventing thermal destruction of ultrasonic vibrator 4.

In the embodiments described above, drive transmission C which is composed of motor 12, pulley 13 and belt 14, is used, but magnetic rotating plate 5 can be rotated directly by motor 12. Also, there may be a variety of combinations of different switches in body 2, and therefore, the arrangement shown in the drawings should not be understood as the limits of the invention. Although not shown in the drawings, means for keeping liquid A warm or cold, may be provided to vessel 1 or body 2.

What is claimed is:

1. A magnetic type agitator comprising:

a magnetic agitator element disposed inside a magnetically permeable vessel;

a magnetic rotating plate rotatably disposed below a bottom of said vessel for driving said magnetic agitator and thereby agitating liquid inside of said vessel by rotating said magnetic rotating plate; and an ultrasonic vibrating element fixed to the bottom of said vessel; said magnetic rotating plate being placed so as to permit the magnetic force from said magnetic rotating plate to effect said magnetic agitating element, thereby permitting simultaneous agitation and ultrasonic vibration of said liquid in said vessel.

2. A magnetic type agitator according to claim 1, wherein said vessel includes an interior space, a container being disposed in said interior space, said container containing said liquid, and said magnetic agitating element being disposed within said container and wherein an annular space defined between said vessel and said container is filled with a medium which permits transmission of ultrasonic vibration.

3. Magnetic type agitator according to claim 2 wherein said vessel is integrally formed with the body of said agitator.

4. Magnetic type agitator according to claim 3 further including a plurality of containers disposed in said interior space of said vessel.

5. Magnetic type agitator according to claim 1 or 2 wherein said ultrasonic vibrating element 4 is an electrostriction vibrating element.

6. Magnetic type agitator according to claim 1 further including a plurality of vessels each having an ultrasonic vibrating element disposed on a bottom thereof, said magnetic rotating plate being placed so as to permit the magnetic force from said magnetic rotating plate to effect said magnetic agitation element, thereby permitting simultaneous agitation and ultrasonic vibration of said liquid in each said vessel.

7. A magnetic type agitator comprising:

a magnetically permeable vessel filled with a liquid to be agitated;

a magnetic agitator element disposed in said liquid within said vessel and positioned on the bottom of said vessel for free motion thereof;

a magnetic driver provided below the bottom of said vessel and establishing a magnetic field across said magnetic agitating element, said magnetic driver rotating said magnetic element within said liquid for promoting agitation of said liquid; and an ultrasonic vibration driver being in cooperation with said vessel for transmitting ultrasonic vibration to said vessel for inducing ultrasonic vibration in said liquid.

8. A magnetic type agitator comprising:

a magnetically permeable vessel filled with a liquid to be agitated;

a magnetic agitator element disposed in said liquid within said vessel and positioned on the bottom of said vessel for free motion thereof;

a magnetic driver provided below the bottom of said vessel and establishing a magnetic field across said magnetic agitating element, said magnetic driver rotating said magnetic element within said liquid for promoting agitation of said liquid; and an ultrasonic vibration driver disposed between the bottom of said vessel and said magnetic driver for transmitting ultrasonic vibration to said vessel for inducing ultrasonic vibration in said liquid.

9. A magnetic type agitator comprising:

a magnetic permeable vessel filled with a liquid to be agitated;

a magnetic agitator element disposed in said liquid within said vessel and positioned on the bottom of said vessel for free motion thereof;

a magnetic driver provided below the bottom of said vessel and establishing magnetic field across said magnetic agitating element, said magnetic driver rotating said magnetic element within said liquid for promoting agitation of said liquid; and an ultrasonic vibration driver being in cooperation with said vessel for transmitting ultrasonic vibration to said vessel for inducing ultrasonic vibration in said liquid simultaneously with agitation by said magnetic agitator element.

10. Magnetic type agitator according to claim 7, 8 or 9, wherein said liquid includes a pulverized material being dissolved therein by said agitation and said vibration.

* * * * *